US006581230B2

(12) United States Patent
Weinmann

(10) Patent No.: US 6,581,230 B2
(45) Date of Patent: Jun. 24, 2003

(54) METHOD OF WASHING LAUNDRY IN A MOTOR-DRIVEN WASHING MACHINE

(75) Inventor: Martin Weinmann, Bad Waldsee (DE)

(73) Assignee: Diehl AKO Stiftung & Co. KG, Wangen (DE)

( * ) Notice: Subject to any disclaimer, the term of this patent is extended or adjusted under 35 U.S.C. 154(b) by 43 days.

(21) Appl. No.: 09/989,551

(22) Filed: Nov. 20, 2001

(65) Prior Publication Data

US 2002/0029428 A1 Mar. 14, 2002

Related U.S. Application Data

(63) Continuation-in-part of application No. 09/421,132, filed on Oct. 19, 1999, now abandoned.

(30) Foreign Application Priority Data

Oct. 27, 1998 (DE) ..... 198 49 403

(51) Int. Cl.[7] ..... D06F 33/02

(52) U.S. Cl. ..... 8/159; 68/12.02; 68/12.04

(58) Field of Search ..... 8/159; 68/12.04, 68/12.02

(56) References Cited

U.S. PATENT DOCUMENTS

| | | | |
|---|---|---|---|
| 4,779,430 | A | 10/1988 | Thuruta et al. |
| 5,233,847 | A | 8/1993 | Tanaka |
| 5,275,025 | A | 1/1994 | Nakamura et al. |
| 5,743,115 | A | 4/1998 | Hashimoto |

FOREIGN PATENT DOCUMENTS

| | | |
|---|---|---|
| DE | 44 31 846 A1 | 3/1996 |

*Primary Examiner*—Philip R. Coe
(74) *Attorney, Agent, or Firm*—Scully, Scott, Murphy & Presser

(57) ABSTRACT

A method for the washing of laundry in a motor-driver washing machine. The laundry method is intended to optimize the washing procedure with respect to the amount of mechanical energy which is needed in order to achieve the desired cleaning effect on the laundry.

19 Claims, No Drawings

METHOD OF WASHING LAUNDRY IN A MOTOR-DRIVEN WASHING MACHINE

CROSS-REFERENCE TO RELATED PATENT APPLICATION

This application is a continuation-in-part application of Ser. No. 09/421,132; filed on Oct. 19, 1999, and now abandoned.

BACKGROUND OF THE INVENTION

1. Field of the Invention

The present invention relates to a method for the washing of laundry in a motor-driver washing machine. More particularly, the laundry method pursuant to the invention is intended to optimize the washing procedure with respect to the amount of energy which is needed in order to achieve the desired cleaning effect.

According to the invention it is intended to define the mechanical energy acting on the laundry during the washing cycle. This mechanical energy in a vertically rotating drum of the washing machine is induced into the laundry by an arm additionally rotating the agitator for the fluid flow; and in the case of a washing machine equipped with a horizontal rotating drum, it is introduced mainly by the successive lifting and falling movements of the laundry within the drum; in effect, the mechanical energy as actually introduced herein primarily depends upon the filling rate of the drum.

Inasmuch as the introduced mechanical energy is an equivalent to the electrical energy assumed by driving motor of the drum in the case of a vertically rotating drum, the mechanical energy may be measured by measuring the electrical energy which has been consumed during the washing cycle. In the case of the horizontal rotating drum; however, there has to be taken into account the filling degree of the drum, and additionally, to obtain the mechanical energy which has acted onto the laundry during the washing cycle.

2. Discussion of the Prior Art

In order to evaluate the actual filling of the drum, the German Patent Publication DE 44 31 846 A1 describes a method of operating which is driven, on the one-hand, at a constant speed of rotation and on the other hand, with a constant angular acceleration and torques which are to be, respectively, applied by the drive motor for this purpose, are then compared. That comparative measurement serves to determine the imbalance of the drum in order to ascertain therefrom the maximum possible speed of rotation in the spin or centrifuging mode.

SUMMARY OF THE INVENTION

However, that procedure for determining the drum loading is expensive inasmuch as the drum which is laden with laundry must first be run for a certain period of time in two different modes; such as a constant speed of rotation and a constant angular acceleration, and the torques which are to be respectively applied by the motor in that instance must be determined and ultimately evaluated.

Accordingly, it is an object of the present invention to quickly and easily detect the loading of a horizontally rotating washing drum by taking it into account in the implementation of a washing program based on constant mechanical energy which is to be introduced into the laundry, since this energy depends upon the actual load filling of the horizontally rotating laundry drum.

According to this object, inventively, if the power draw of the electric motor which drives the washing drum is measured, then the drum loading can be inferred therefrom. In the event that the washing drum is fully laden, the electric motor only has to overcome friction and, upon acceleration must overcome the mass inertia, and therefore only draws a comparatively small amount of power. If, on the other hand, the drum is not fully laden (for example; is only half-full) the motor must then convey the entire wash upwardly against the force of gravity before it drops down again, without in the case as would be the instance with a fully loaded drum, with the impetus or momentum being transmitted back to the washing drum. As a consequence, the electric motor requires an overall higher level of power, and for that reason its power draw is comparatively considerably high.

Basically, the primary concept underlying the invention resides in that the laundry, in order to obtain a constant remaining washing result, has imparted thereto a uniformly remaining or constant quantity of mechanical energy. This of a particularly practical interest for washing machines with horizontally rotating drum which are filled to considerably different degrees. At a full loading the laundry is located in a packed manner in the drum and rotates in conjunction therewith. In contrast therewith, at a lower amount of loading, the individual laundry pieces are raised with the rotation of the drum so as to again fall down under the effects of gravity. Consequently, at a lower degree or amount of loading, a higher mechanical energy acts on the laundry, and the washing procedure can be either shortened or maintained through lengthier pauses (such as in the course of a periodic switching over of the direction of rotation) to a constant duration however at a reduced mechanical energy effect.

In addition to the foregoing, the invention is also directed to washing machines with vertical rotating drums, in which an agitator causes a flow of water through the laundry, and additionally a rotating arm maintains the laundry in motion. Also, in this instance, does the degree of filling of the drum influences the mechanical energy which is introduced into the laundry; when concurrently the dominating influence originates here from the duration of operation of the rotating arm; in effect, from an additional aspect which can be directly measured through the power pick-up of the electrical drive motor.

Used as a measure for the degree of cleaning, in effect, as a measure of the mechanical cleaning power which is introduced to the laundry pieces, for horizontal washing drums there is initially employed the electrical power which is received by the drive motor for the drum, which can be measured without any problem and at regulated drives is already available as a measurement value. This measuring procedure, as such, is not the inventive aspect itself, but rather the time of limitation or gap in the washing process in that, at the end of a washing process independently of the momentary of the loading of the drum there always acts the same mechanical energy on the laundry.

The power draw of the electronic motor can be detected during the normal washing phase, or also when the motor is being accelerated up to a predetermined speed of rotation is being maintained. The step of determining the power draw is effected by measuring the motor current, the motor speed and the electric voltage applied to the motor. The power draw is that from the power mains or the power which is outputted by the electronics for motor control.

With a possession of knowledge over the power losses which occur, the mechanical power acting on the laundry in the drum can be determined from the power draw of the electronic motor. With a higher level of power draw on the part of the motor, a higher level of mechanical power is also transmitted to the laundry. Thus, if now the loading of the washing drum and the mechanical power acting on the laundry were known by virtue of ascertaining the power draw of the electronic motor, the operating procedure of the washing program would be of such a configuration that the laundry, or a predetermined amount of laundry, is throughout the entire washing program always acted upon with substantially the same predeterminable mechanical energy irrespective as to whether the washing drum is or is not full.

In modern household washing machines, the washing program often starts with displaying the time needed for the individual washing program which was actually selected. In order to keep this time independent from the actual loading of the horizontal rotating drum but with a given and constant mechanical power acting on the laundry, the drive interruptions of the turn or between reversed turns of the drum may be increased or shortened in their periods of time, depending on the actual load. With a vertical rotating drum; however, the turn speed of the rotating arm may be varied according to the load of the drum in order to keep the originally indicated washing time with a predetermined integral of mechanical energy induced into the laundry during the washing time.

The invention is described in grater detail hereinafter by means of examples. Even through the examples are generally applicable to both types of washing machines (with horizontally rotating drum and with vertical rotating axis of the drum), the latter case is the preferred one in the description set forth hereinbelow.

DETAILED DISCUSSION OF PREFERRED EMBODIMENTS

The power draw of the electronic motor is determined during the first washing cycle. If the drive electronics of the motor measures the mains current draw, as is the situation for example, in the case of drives with an intermediate voltage circuit and actively controlled current draw (PFC) measurement of the electrical power draw of the motor electronics from the current mains is usefully implemented. If the motor electronics do not measure the mains current draw, there is implemented a measurement of the power outputted by the electronics to the motor. The value which is measured in that manner of the power draw of the electronic motor is compared with values which are stored for various drum filling states or conditions; for example, in the program control, and in that manner the loading of the washing drum is ascertained.

The power draw of the electronic motor is also used by way of a stored, drum-specific characteristic curve in order to determine the mechanical power with which the laundry in the drum is acted upon. Because of inevitable power losses only a part of the power drawn by the motor is available in the form of mechanical power acting on the laundry. If the power draw from the current mains is measured, the power losses which are caused by the motor electronics the electronic motor transmission to the drum and the water in the drum must be taken into account. When the power which is supplied to the electronic motor by the motor electronics is measured, the power loss of the motor electronics does not need to be also included. In both instances, the mechanical power acting on the laundry is about one-fifth of the originally drawn power. The power losses which are encountered are taken into account in the drum-specific characteristics curve.

Instead of ascertaining the power losses of the individual components of the chain of action consisting of motor electronics-electric motor-transmission-washing drum the respective washing result can also be determined with regard to various predetermined values in connection with the power draw, and stored, for example, in the form of a characteristics curve.

The program control now takes cognizance of the loading of the washing drum and the mechanical power acting on the laundry, or the washing power, and configures the operating procedure involved in the washing program in such a way that the laundry, or a predetermined amount of laundry irrespective of the drum loading, is always acted upon with approximately the same predeterminable mechanical washing power. That can be effected insofar as, throughout the entire washing operation, the power draw of the electric motor is measured, the mechanical power acting on the laundry or the washing power is determined therefrom and washing is pursued until the mechanical energy or washing work which is transmitted overall to the laundry which is ascertained by integration of that mechanical power or washing power over the entire washing operation reaches a value which is required for a satisfactory washing result. When it is only at the beginning of the washing program that the power draw of the electronic motor is measured, then the necessary washing time is calculated therefrom. In the case of a low power draw of the electronic motor being measured, then the necessary washing time is calculated therefrom. In the case of a low power draw on the part of the electronic motor, when the washing drum is fully laden and with a comparatively low level of transmission of mechanical power to the individual laundry item, the washing program is of longer duration then in the case of a high power draw on the part of the electronic motor, in essence, with only partial loading of the washing drum and a comparatively high level of transmission of mechanical power to the individual laundry item. Instead of altering the duration of the entire washing program, it is also possible to alter the duration of individual wash cycles or the reversing cycles of the washing drum.

It should be noted that with a low level of power draw in respect of the electric motor, a longer washing program is necessary for the reason that, on the one hand, more laundry has to be washed and, on the other hand, that larger amount of laundry is also acted upon with a comparatively low level of mechanical power or washing power. In comparison, with a higher level of power draw on the part of the electric motor, the washing program is reduced in length as less laundry has to be washed, and it is acted upon with a comparatively high level of mechanical power or washing power. That provides for a savings in terms of time and electrical energy.

Alternatively, or in addition thereto, in the situation involving a lower level of drum loading, the electric motor power draw is reduced. That prevents the imposition of an unnecessary excessive mechanical loading or strain on the laundry. At the same time; however, there is still ensured that the laundry is always acted upon with the desired mechanical energy or washing energy in order to guarantee a satisfactory washing result even if the washing drum is fully loaded.

By virtue of having knowledge over the loading of the washing drum, the amount of water and/or detergent being used can be adapted to the actual conditions and periods of time.

A saving in terms of water is preferably achieved by the level of water in the washing drum after a given minimum filling level is attained; this being increased until the power draw of the electric motor reaches a predetermined value. That procedure is based on the fact that the power draw of the electric motor depends not only upon the amount of laundry but also on the amount of water in the running drum. When washing a partial load (for example, with a half-load) the power draw of the electric motor is already high by virtue of the laundry load and for that reason the water is not introduced above the minimum filling level but washing is effected with the minimum filling quantity which, in this case, is also sufficient for the partial load. When the washing drum has a full load in contrast therewith, then the power draw of the electric motor is low by virtue of the load. Therefore, water is supplied above the minimum filling level until the electric motor reaches the predetermined power draw. This then ensures that with a full load in the drum when a larger amount of washing water is required, washing is also implemented with more water.

When using an automatic detergent metering device, a savings in detergent is preferably achieved by less detergent being supplied to the washing drum when dealing with a partial load.

With the washing programs which are currently most frequently used, at lower water temperatures (up to 60° Celsius), the washing mechanism assumes a noticeable proportion of the energy consumption in comparison with the heating system. Accordingly, the above-described energy savings, by virtue of a reduction in the length of the washing program and/or by virtue of a decrease in the power draw of the electric motor with a partial load in the washing drum results in a noticeable savings in the total required energy.

A saving in time is preferably achieved by virtue of the fact that with a partial load in the washing drum, the washing phases and/or the rinsing phases are reduced in length or are terminated when sufficient mechanical energy has been applied to the laundry.

When in the case of an originally relatively high level of power draw by the electric motor that power is reduced because; for example, a relatively high level of mechanical power acting on the laundry or washing power is not required, the power stage of the motor control electronics, the power semiconductors, the cooling bodies and also the electric motor itself can be sized for relatively small continuous power levels without exerting an adverse influence on the washing result.

Finally, it should also be noted that the power draw of the electric motor is also low when only very few items of laundry are contained in the drum. In this case; however, also the mechanical power applied to those few items of laundry, or washing power is comparatively slight as the individual items of laundry then hardly rub against each other. Accordingly, it is also advantageous, in this case, to prolong the duration of the washing program in accordance with the described embodiment of the invention in order to ensure the desired washing result.

While the invention has been particularly shown and described with respect to preferred embodiments thereof, it will be understood by those skilled in the art that the foregoing and other changes in form and details may be made therein without departing from the spirit and scope of the invention.

What is claimed is:

1. A method for the washing of laundry in a washing drum of a washing machine; comprising imparting mechanical power to said laundry; a power draw of an electronic motor turning said drum through a stored drum-specific characteristics curve, said mechanical power being responsive to said drum-specific characteristics curve so as to control the timed duration of washing cycles whereby the laundry irrespective of the actual load in the drum is always acted upon by substantially same predeterminable amount of mechanical energy.

2. A method as claimed in claim 1, wherein said washing machine drum comprises a horizontally rotating washing drum.

3. A method as claimed in claim 2, wherein at a partial load of laundry in said washing drum individual laundry pieces are lifted and then fall under the influence of gravity so as to cause a higher mechanical energy to act on said laundry to facilitate a shorter washing cycle or through lengthier pauses are maintained in a constant washing duration at a reduced mechanical energy effect.

4. A method as claimed in claim 1, wherein said washing machine drum comprises a vertically rotating washing drum.

5. A method as claimed in claim 4, wherein said mechanical energy introduced into the laundry is influenced by the degree of loading of the drum.

6. A method as claimed in claim 5, wherein an agitator causing a flow of water to circulate through the laundry in said drum.

7. A method as claimed in claim 6, wherein the amount of laundry loaded into said drum influences the mechanical energy introduced into said laundry, and a major portion of the influence emanates from the speed of rotation and duration of the rotation of a rotating arm which is measurable through the power pick-up of the electric motor driving said drum.

8. A method as claimed in claim 1, wherein the power draw of the electric drive motor is detected during the washing cycle.

9. A method as claimed in claim 1, wherein the measurement of the power draw of the electric drive motor is carried out during acceleration of the motor up to a predetermined speed of rotation.

10. A method as claimed in claim 1, wherein the measurement of the power draw of the electric drive motor is carried out while maintaining a predetermined speed of rotation of the motor.

11. A method as claimed in claim 1, wherein the power draw of the electric drive motor is determined by the extent of the power draw from the electrical current mains.

12. A method as claimed in claim 1, wherein the power draw of the electric drive motor is ascertained from the power outputted by control electronics for the electric drive motor.

13. A method as claimed in claim 1, wherein a full load of laundry in the washing drum requires a low power draw and a partial laundry load in the washing drum requires a higher level of power draw.

14. A method as claimed in claim 13, wherein the low power draw of the electric drive motor is obtained with the washing drum being filled with laundry and with the laundry resultingly being acted upon with a comparatively low level of mechanical power, whereby the washing cycle assumes a longer duration while a switched-on duration of reversing cycles is lengthier.

15. A method as claimed in claim 13, wherein the higher power draw of the electric drive motor is obtained with the washing drum being partially filled with laundry and the laundry being acted upon with a comparatively high level of mechanical power, produces a washing cycle of shorter duration while a switched-on duration of reversing cycles is shortened.

16. A method as claimed in claim 1, wherein the duration of the washing cycle is selected such that the total mechanical energy transmitted to the laundry is ascertained by integration of the mechanical power acting on the laundry over the entire washing cycle, reaches a value which is required for a specified washing result.

17. A method as claimed in claim 1, wherein upon a detection of a relatively high level of power draw by the motor indicative of a relatively low amount of laundry in the washing drum and resultingly a relatively high level of mechanical power acting on the laundry, there is reduced the power draw of the electric drive motor.

18. A method as claimed in claim 1, wherein a supplied amount of washing water is correlated with the amount of laundry loaded in the washing drum, whereby upon a minimum water level being exceeded, the supply of water is continued until the power required for the driving of the washing drum reaches a predetermined value.

19. A method as claimed in claim 1, wherein an amount of detergent supplied is correlated with the load of laundry in the washing drum, in that an automatic metering device for the detergent causes less detergent to be added when the washing drum contains only a partial load of laundry.

* * * * *